United States Patent [19]

Muller

[11] 3,996,974

[45] Dec. 14, 1976

[54] DEVICE FOR WINDING BOBBINS WITH FILLING THREADS

[75] Inventor: Walter Muller, Tann-Ruti, Switzerland

[73] Assignee: Ruti Machinery Works Ltd., Ruti, Switzerland

[22] Filed: Aug. 5, 1975

[21] Appl. No.: 602,067

[30] Foreign Application Priority Data

Aug. 16, 1974 Switzerland ..... 11212/74

[52] U.S. Cl. ..... 139/436; 139/224 R

[51] Int. Cl.[2] ..... D03D 47/26; D03D 45/00

[58] Field of Search ..... 139/12, 13 R, 224 R, 139/224 A, 122 R, 122 W, 126, 436, 450, 452, 453

[56] References Cited

UNITED STATES PATENTS

| | | | |
|---|---|---|---|
| 3,724,508 | 4/1973 | Jekl et al. | 139/12 |
| 3,732,896 | 5/1973 | Jekl et al. | 139/12 |
| 3,835,893 | 9/1974 | Galperin et al. | 139/12 |
| 3,862,648 | 1/1975 | Langr et al. | 139/12 |

FOREIGN PATENTS OR APPLICATIONS

| | | | |
|---|---|---|---|
| 2,116,845 | 9/1972 | Germany | 139/436 |
| 2,118,445 | 11/1971 | Germany | 139/12 |
| 157,292 | 7/1962 | U.S.S.R. | 139/224 R |
| 144,751 | 5/1961 | U.S.S.R. | 139/224 R |

*Primary Examiner*—James Kee Chi
*Attorney, Agent, or Firm*—Donald D. Denton

[57] ABSTRACT

The present device covers the winding of bobbins with filling threads, which are to be introduced in a weaving shuttle into the shed of a loom, the device having a receiving station, a winding station, and a delivery station.

20 Claims, 8 Drawing Figures

DEVICE FOR WINDING BOBBINS WITH FILLING THREADS

BACKGROUND OF THE INVENTION

The present invention relates to a device for winding bobbins with filling threads which are to be introduced in a weaving shuttle into the shed of a loom, preferably an undulated-shed or wave-type loom, having a receiving station, a winding station, and a delivery station, said stations having a plurality of sections, with a first transport means or device for the stepwise transporting of the bobbins positioned in shuttles from one station to the next and with one rotating winder each associated in fixed position with each section of the winding station and removing the filling thread from a supply bobbin.

In one known device of this type, the first transport device is formed by a drum on the periphery of which receiving pins for the bobbins are arranged which extend radially out of the drum at equal distances apart. The drum is rotatable step by step by angles of rotation which correspond to the angle between two receiving pins. At a given fixed point of the circumference of the drum, a bobbin is transferred each time to the receiving pin which is positioned there at the time. Thereupon the drum is moved forward one step, the bobbin is wound, the drum is again moved forward one step, and the bobbin is delivered out of the device and introduced into the shed.

This known device can be so constructed by the combining of a plurality of drums of the type described that several bobbins can be wound simultaneously at the winding station. Also, for a given filling frequency, the winding speed upon the winding of the bobbins is reduced proportional to the number of drums. It is not clear how with this device in the receiving station the feeding of the bobbins into the individual drums could be effected without considerable expense for apparatus. The same is true for the delivery of the bobbins from the delivery station.

The closest prior art known to applicant in connection with this application is Swiss Pat. No. 540,364.

SUMMARY OF THE INVENTION

The invention avoids the above described drawback and is characterized by the fact that each station has the same number of sections and that a second transport means or device is provided for the stepwise filling of the receiving station and the stepwise emptying of the delivery station, the second transport device within the receiving and delivery station connecting the individual sections with each other and so cooperating with the first transport means or device that a number of transport steps of the second transport device, corresponding to the number of sections of the individual stations, takes place between every two transport steps of the first transport device.

Since the individual sections of the receiving and delivery stations are connected with each other by the second transport device and the second transport device is coupled with the first, there is obtained the great advantage of a simple feeding of the bobbins into and their simple removal out of the device in accordance with the invention. The bobbins which are delivered by an independent return transport device are taken over one after the other in proper cadence by the second transport device and transported into the first section of the receiving station. As soon as the receiving station is filled after a number of transport steps of the second transport device corresponding to the number of sections, the first transport device makes a transport step and conveys all bobbins present in the receiving station into the winding station. While all bobbins are simultaneously wound in said station, the receiving station is again filled with empty shuttles. The winding of the bobbins is terminated simultaneously with the new filling of the receiving station. As soon as the winding has been terminated and therefore also after a number of transport steps of the second transport device corresponding to the number of sections, the first transport device in one transport step conveys the shuttles with the wound bobbins therein out of the winding station into the delivery station and the shuttles with empty bobbins therein out of the receiving station into the winding station. In the receiving and winding stations, the procedures already described take place again; the shuttles with wound bobbins therein present in the delivery station are delivered by the second transport device stepwise and synchronously with the filling of the receiving station out of the delivery station and introduced by an independent transport device into the shed. The delivery of all bobbins stored in the delivery station thus takes place also in a number of transport steps corresponding to the number of sections.

A preferred embodiment of the device in accordance with the invention is characterized by the fact that the first and the second transport devices are each formed by endless first and second conveyor belts which are developed in the manner of toothed belts and guided over rollers, a separate first conveyor belt common to all stations being provided for each section of the stations and a separate second conveyor belt common to all sections of the receiving and delivery stations being provided for said stations; that the individual conveyor belts are adapted to be driven by a common step-by-step gearing, and that all stations and sections are arranged in a common plane and the first conveyor belts forming the first transport device are directed perpendicular to the second conveyor belts forming the second transport device.

In this preferred embodiment of the device in accordance with the invention, therefore, the individual drums of the known device are replaced by a flat matrix-like system of toothed belt-like conveyor belts which are adapted to be driven by a common step-by-step gearing. Thus in practice, the complicated system of shafts, cams, levers, spur gears, etc., used in the known device is replaced by a single drive which with constant step-number ratio drives a drive shaft for the second transport device.

BRIEF DESCRIPTION OF THE DRAWINGS

These and other objects of the invention will become apparent from the following description of preferred embodiments with reference to the illustrative embodiments and drawings, in which.

DESCRIPTION OF PREFERRED EMBODIMENTS

Figure 1:
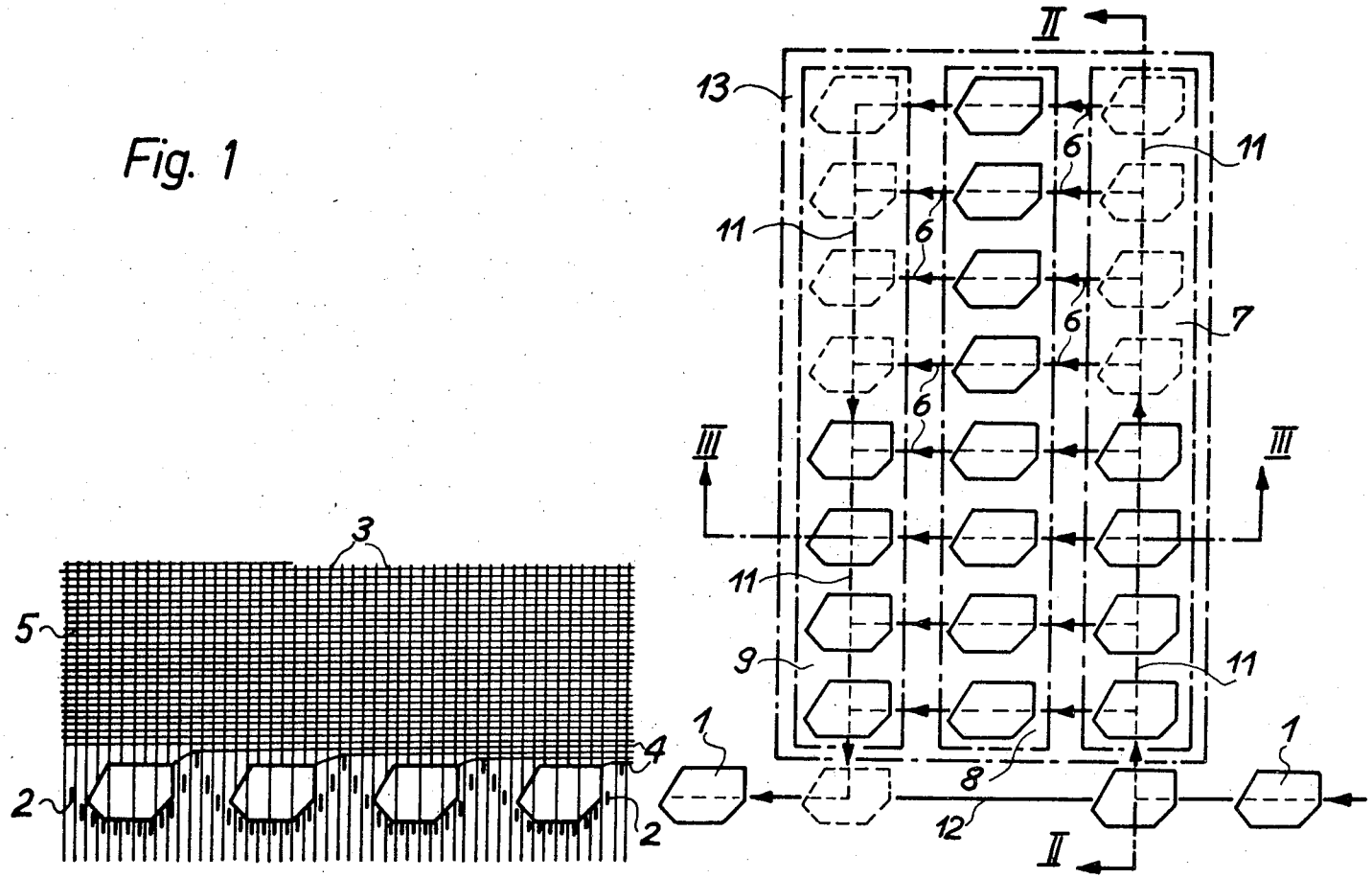
FIG. 1 shows a schematic top view of a device in accordance with the invention.

Referring to FIG. 1 of the drawings, a device 13 for winding the bobbins of the shuttles 1 is arranged on one side of the row of warp threads 3 of an undulated-shed type loom. Shuttles 1 are transported by known means, for instance by blades or reed teeth 2 as shown in the drawing, through the sheds formed by the warp threads 3 and in this connection insert one filling thread 4 into each shed. The beating of the filling threads 4 up against the fabric 5 is effected by known means, for instance as shown in the drawing also by the blades 2.

After emergence from the sheds, the shuttles 1 are caused to change their direction and are transported back in known manner by a return transport device or conveyor means where they are again filled with filling threads. For this purpose, the return transport device 12 is moved past the winding device or mechanism 13. The winding mechanism consists of a receiving station 7, a winding station 8 and a delivery station 9. Each of these stations consists of a plurality of sections, each station having the same number of sections and each station being adapted to receive one shuttle. Accordingly, in the figure each of the shuttles 1 shown in solid or dashed line in the receiving, winding, and delivery stations 7, 8 and 9 symbolically represents one section. A shuttle drawn in solid line means that a shuttle is actually present at this time in the section concerned while a shuttle drawn in dashed lines means that the corresponding section is empty of a shuttle at this time.

The empty shuttles 1 delivered by the return transport means 12 are fed via the lowermost section in the figure of the receiving station 7 into the station and are delivered again filled with filling threads from the lowermost section, as seen in FIG. 1 of the delivery station 9.

Each section of the receiving station 7 is connected via a first transport means 6 with the corresponding section of the winding station 8, and each section of the winding station 8 is connected via the first transport means with the corresponding section of the delivery station 9. The first transport device 6 thus connects the first section of the receiving station 7 with the first section of the winding station 8 and the first section of the winding station 8 with the first section of the delivery station 9, etc. The first transport device 6 is adapted to be driven stepwise simultaneously for all sections. With one transport step, it is capable of transporting all shuttles present in the station into the neighboring station in the direction indicated by arrows.

In the receiving station 7 and the delivery station 9 the separate second transport devices 11 connect the individual sections together. The second transport device 11 which serves to fill the receiving station 7 and to empty the delivery station 9 is adapted to be driven in steps; its direction of transport as indicated by arrows is opposite in the delivery station 9 the direction of transport in the delivery station 7.

The first transport device 6 and the second transport device 11 or the step drives actuating the two transport devices are so connected together that a number of transport steps of the second transport device 11 corresponding to the number of sections in the individual stations takes place between every two transport steps of the first transport device 6. The second transport device 11 is furthermore so coupled with the continuously drivable return transport device 12 which returns the empty shuttles 1 that, whenever an empty shuttle 1 is offered at the receiving station 7, the second transport device 11 carries out one transport step.

The manner of operation of the device described is as follows: The return transport device 12 turns over the empty shuttles 1 in succession to the second transport device 11 which carries out one transport step after the turning over of each shuttle and transports the corresponding shuttle into the first section of the receiving station 7. At the same time all shuttles already introduced into the receiving station are transported by the second transport device 11 from the section in which they happen to be into the next following section in the direction of transport. This process is repeated until all sections of the receiving station 7 are provided with a shuttle 1. In the example having 8 sections per station shown in FIG. 1, therefore, after eight transport steps of the second transport device 11, all sections of the receiving station 7 are filled with a shuttle 1.

As already stated, in the delivery station 9 the direction of transport of the second transport device 11 is opposite the direction in the receiving station 7. Aside from this, the transport movements in the said two stations take place completely synchronously. Whenever the return transport device 12 turns over an empty shuttle 1 to the second transport device 11 of the receiving station 7, the second transport device 11 of the delivery station 9 turns over a filled shuttle 1 to the return transport device 12. With each transport step of the second transport device 11, all shuttles 1 in the delivery station 9 are transported from the section in which they happen to be into the next following section in the direction of transport. After a number of transport steps corresponding to the number of sections in the delivery station 9 (for example, after eight transport steps in the case of the embodiment shown by way of example in FIG. 1), all shuttles filled with weft thread are delivered out of the delivery station 9 and to the shed.

If upon the nth transport step of the second transport device 11, the first empty shuttle 1 is introduced into the empty receiving station 7 and the first filled shuttle 1 is delivered out of the full delivery station 9, then the receiving station 7 is full and the delivery station 9 empty after the $(n+7)$th transport step.

During the time between the $(n+7)$th and the $(n+8)$th transport steps of the second transport device, the first transport device 6 which produces the transverse connection between the different stations is activated and carries out one transport step. In this connection the shuttles 1 filled with weft threads in the winding station 8 during the preceding eight transport steps of the second transport device 11 are transported into the delivery station 9 and the empty shuttles 1 which have been introduced into the receiving station 7 are transported into the winding station 8. Upon the $(n+8)$th transport step of the second transport device 11, the condition of the entire system is identical to the condition upon the nth transport step and the processes described begin all over again. The instantaneous condition of the winding device shown in FIG. 1 results after the $(n+3)$th transport step of the second transport device 11.

Figure 2:
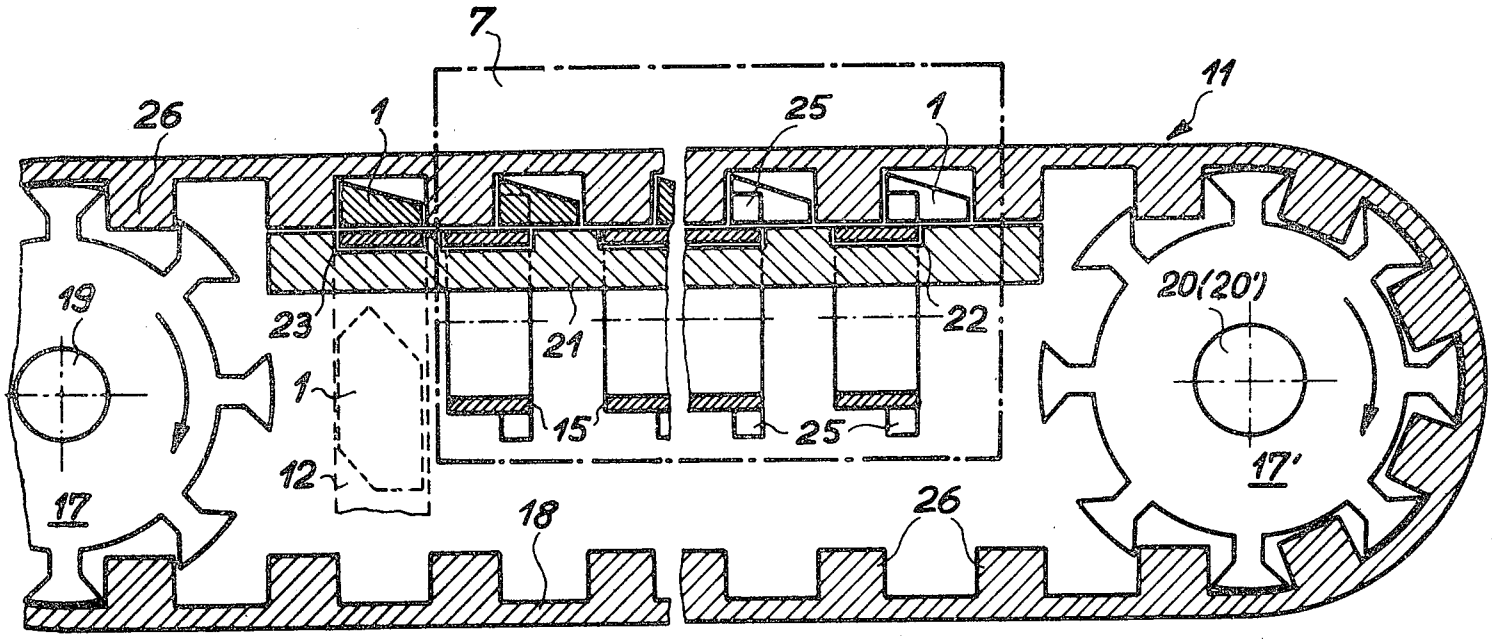
FIG. 2 shows a sectional view along the line II—II of FIG. 1.
Figure 3:
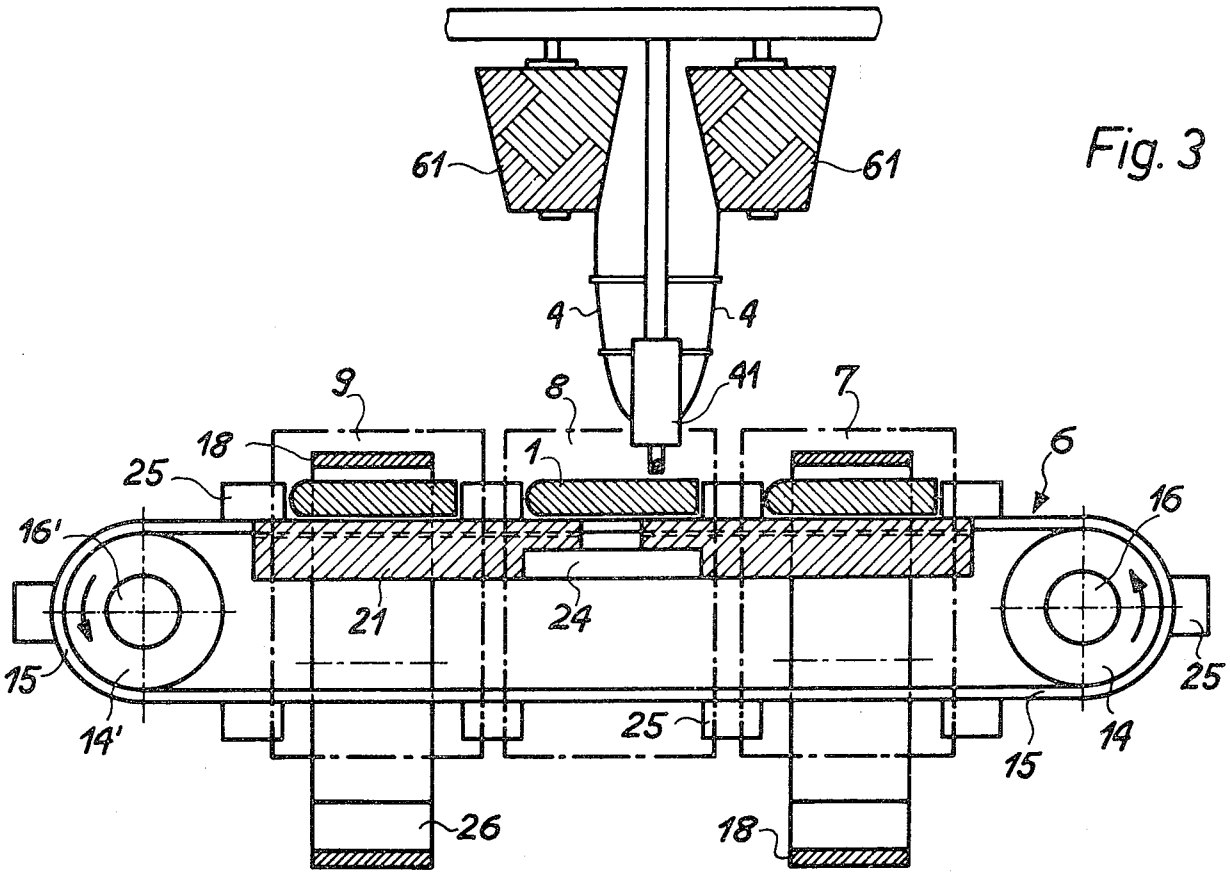
FIG. 3 shows a sectional view along the line III—III of FIG. 1.

In accordance with FIGS. 2 and 3, the first transport device 6 if formed by a number of conveyor belts 15 of toothed-belt type corresponding to the number of sections in the individual stations, the conveyor belts being each guided over a pair of rollers 14, 14'. The rollers 14, 14' are each mounted on a common shaft 16, 16', of which shafts the shaft 16 can be driven stepwise. The second transport device 11 is formed in the receiving station 7 and in the delivery station 9 in each case by a conveyor belt 18, also of toothed-belt type, guided in each case over a pair of gears 17, 17'. The two gears 17 are mounted for free rotation on a common shaft 19 while the two gears 17' are each mounted on a shaft 20, 20' which can be driven stepwise, the two shafts being supported aligned with each other and being connected with each other by a reverse gearing (not shown). As drive for both the first transport device 6 and for the second transport device 11 and therefore for the shafts 16 and 20 and, via the shaft 20 and the reverse gearing also the shaft 20', a common stepping gearing (not shown) is used.

As can be noted furthermore from FIGS. 2 and 3, below the plane of transport of the shuttle 1 there is arranged a fixed guide plate 21 which is common to the receiving station 7, the winding station 8 and the delivery station 9. The guide plate 21 extends below all sections of the said stations and extends under the receiving station and the delivery station out of the stations to below the return transport device 12.

In the region of the winding station 8, the guide plate 21 is provided below each section with a recess 24 for the passage of a winder for the shuttles 1.

The guide plate 21 is provided in the direction parallel to the conveyor belts 15 with a number of guide grooves 22 corresponding to the number of sections per station and with an additional guide groove 23. The conveyor belt 15 are guided in the guide grooves 22 and the return transport device 12 which is also belt-shaped is guided in the additional guide groove 23. In addition to guiding the various conveyor belts, the guide plate 21 serves also as support and base for the convey belts in the individual stations.

The conveyor belts 15, the inner parts of which lie against the rollers 14 and 14', and the guide plate 21 are provided at their outer part with tooth-like projections 25. These projections, which are of parallelepiped shape and the dimension of which in the transverse direction of the conveyor belts 15 amounts to only a part (for instance one-third) of the corresponding dimension of the belt, are arranged spaced apart by an amount corresponding to the length of a shuttle 1 in the longitudinal direction and thus the direction of transport of the conveyor belts 15. The space between every two adjacent projections 25 of each conveyor belt 15 serves to receive a separate shuttle 1; the projections 25 serve as spacers and drivers for the shuttles. For the accurate driving between the rollers 14 and the conveyor belts 15, the belts can be provided with a toothing on their inner side. The rollers 14 and 14' are in this case also toothed.

The conveyor belts 18 have a smooth outer part and an inner part which is provided with tooth-like projections 26. The conveyor belts 18 are so arranged and dimensioned together with the gears 17 and 17' that they surround the conveyor belts 15 and the return transport device 12 from theoutside. The width of the conveyor belts 18 is smaller than the length of the shuttles 1; the distance between the projections 26 which extend over the entire width of each conveyor belt 18 is equal to the height of a shuttle 1. The height of the projections 25 and 26 is in each case somewhat smaller than the thickness of the shuttles 1.

The conveyor belts 18 are so arranged that when they carry out a transport step, and the transport belts 15 are therefore at rest, their projections 26, which serve also as spacers and drivers for the shuttles 1, pass together with the shuttles through the space between the projections 25 of the conveyor belts 15.

The conveyor belts 15 are so arranged that when they carry out a transport step, and the conveyor belts 18 are therefore at rest, their projections 25 pass together with the shuttles through the space between the projections 26 of the conveyor belts 18.

In this way, when the one group of conveyor belts 15 or 18 is stationary, the other group 18 or 15 in each case carries out a transport step without the conveyor belts hindering each other. The spaces between the projections of the conveyor belts of the one group form in each case a guide channel for the shuttles 1 to be transported by the other group of conveyor belts.

Above the shuttle 1 in each section of the winding station 8 there are arranged at least one supply bobbin 61 and a thread metering mechanism 41. If a plurality of supply bobbins 61 (for example two supply bobbins 61 in the case of embodiment shown by way of example in FIG. 3) with different colored filling threads 4 is associated with each section of the winding station 8, and if each thread metering mechanism 41 comprises in addition a color selection device, it is possible to weave not only in one color but in different colors with an undulated loom equipped in this manner.

In the winding station 9 the conveyor belts 15 are each passed by a separate winder arranged in the region of the recess 24 of the guide plate 21. These winders, one of which is provided for each section of the winding station 9, will now be explained in further detail with reference to FIGS. 4 to 7.

Figure 4:
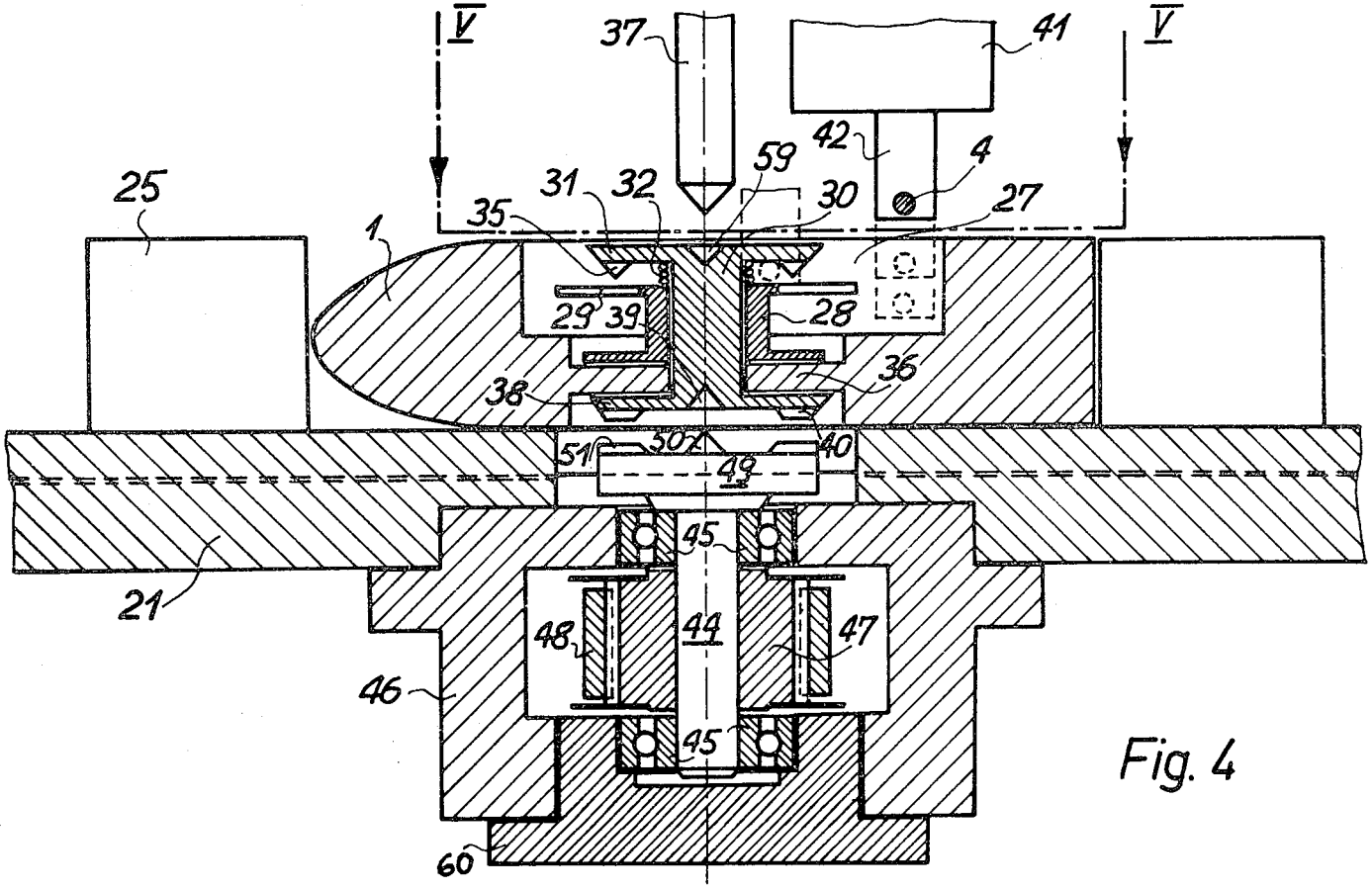
FIG. 4 shows a first embodiment of a winding station of the device in accordance with FIG. 1, viewed in cross-section.
Figure 5:
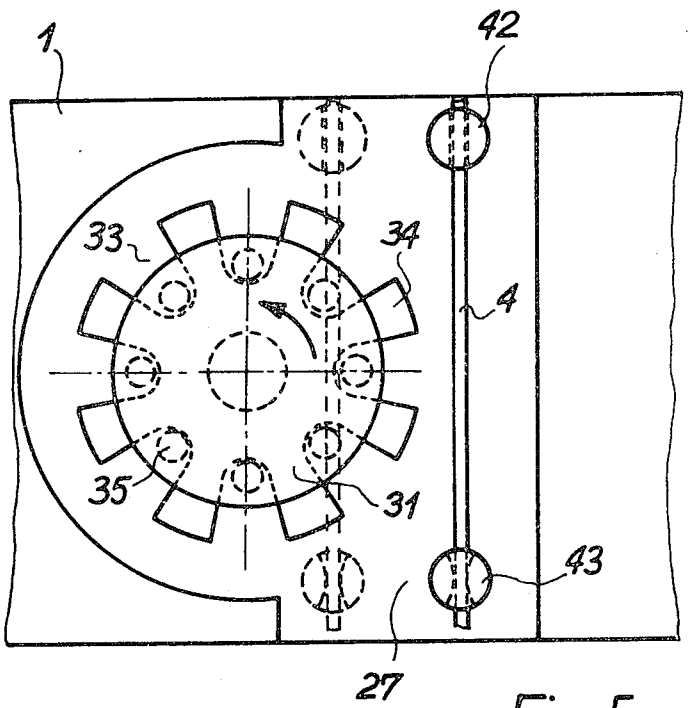
FIG. 5 shows a view on the line V—V of FIG 4.

In accordance with FIGS. 4 and 5, the shuttles 1 have a hollow space 27 in which a bobbin 28 is rotatably supported. The top flange 29 (as seen in FIG. 4) of the bobbin 28 has approximately ratchet-wheel shape with recesses 33 and teeth 34. The bobbin 28 is supported on a driving bobbin 30 which is itself supported for translation and rotation in the hollow space 27 of the shuttle 1, the height of the bobbin 28 being smaller than the inside opening of the driving bobbin 30. In order to fix the bobbin 28 against axial displacement in the driving bobbin 30, there is provided a compression spring 32 which acts between the upper flange 29 of the bobbin 28 and the upper flange 31 of the driving bobbin 30. The upper flange 31 of the driving bobbin 30 is provided towards the outside with a centering bore hole 59 and has, towards the upper flange 29 of the bobbin 28, a number of conical drivers 35 corresponding to the number of recesses 33 in the flange 29. The drivers 35 are so dimensioned and arranged that upon an axial displacement of the driver bobbin 30 downward against the force of the spring 32, during which the bobbin 28 remains at rest as a result of the fact that it lies on a projection 36 of the shuttle 1, they engage into the recesses 33 of the flange 29 whereby the driver bobbin 30 and the bobbin 28 are coupled for rotation. Above the driver bobbin 30 and aligned with it there is rotatably and axially displaceably arranged a pusher 37 which upon lowering engages into the centering bore hole 59 and pushes the driver disk 30 downward.

The lower flange 38 of the driver bobbin 30 is also provided on its outer side with a centering bore 39 as well as a circular contact surface with possibly tooth-like drivers.

Each thread metering mechanism 41 comprises a thread guide eye 42 and a thread brake 43. The guide eye 42 and the thread brake 43 are so arranged that the filling thread 4 passing between them extends in condition of rest of the metering mechanism 41 above the rear free part of the hollow space 27 between the driving bobbin 30 and the shuttle 1 and transverse to the latter. For the winding of the bobbin 28 with filling thread 4, guide eye 42 and thread brake 43 can be lowered either alone or together with the metering mechanism 41 in two steps in vertical direction into the hollow space 27 and moved in one step horizontally to the bobbin 28.

Below the shuttles 1 in each section of the winding station 8 (FIG. 1) there is arranged on the guide plate 21 in the region of the recess 24 (FIG. 3) a winding spindle 44 which is aligned with the pusher 37, the driving bobbin 30 and the bobbin 28 and can be driven in the direction of rotation indicated by an arrow. The winding spindle 44 is connected at its upper and lower ends by ball bearings 45 in a structural part 46 which is firmly connected with the guide plate 21, for instance screwed into it, and in a cover 60 which closes off this structural part from the bottom respectively and is provided in its central part with a gear 47. The gears 47 of the winding spindles 44 of all sections of the winding station 8 (FIG. 1) are adapted to be driven via a common toothed belt 48 from a motor (not shown). The winding spindle 44 is provided at its upper end extending out of the bearing 45 with a driving flange 49 which, towards the lower flange 38 of the driving bobbin 30, has a centering projection 50 and a circular contact surface 51 with possibly tooth-like drivers. Upon the lowering of the driving bobbin 30 by the pusher 37 with centering by the centering bore hole 39 and the centering projection 50, the two contact surfaces 40 and 51 which represent a clutch are pressed against each other whereby the movement of rotation of the winding spindle 44 is transmitted to the driving bobbin 30 and from the latter to the bobbin 28.

The manner of operation of the winder described is as follows: By the conveyor belts 15 a group of shuttles 1 is in each case transported into the winding station 8 and each shuttle is positioned between pusher 37 and/or metering mechanism 41 on its top side and winding spindle 44 on its bottom side. As soon as the shuttles 1 are positioned, thread eye 42 and thread brake 43 are lowered in a first step until the filling thread 4 lies at the level of the outer limiting surface of the upper range 29 of the bobbin 28. Thereupon thread eye 42 and thread brake 43 are transported horizontally into the position shown in dashed line in FIG. 5. Thereupon the pusher 37 is lowered and presses the driving bobbin 30 against the bobbin 28, the filling thread 4 being clamped fast between the upper limiting flanges 29 and 31 of the two bobbins and being secured against slipping out laterally by the drivers 35. By the lowering of the pusher 37 the driving bobbin 30 is pressed furthermore against the driving flange 49 of the winding spindle 44. At the same time thread eye 42 and thread brake 43 are moved back horizontally from the position shown in dashed line in FIG. 5 into the position shown in solid line and thereupon lowered to below the level of the inner surface of the upper flange 29 of the bobbin 28.

The winding spindle 44 and thus also the driving spindle 30 and the bobbin 28 now start to rotate in the direction indicated by an arrow in FIG. 5. The end of the filling thread 4 is pulled out of the thread brake 43 and begins to turn with the bobbin 28 as a result of which the thread, which is deflected as a result of the second lowering movement of thread eye 42 and thread brake 43 from the outer limiting surface of the upper flange 29 around its circumference against the winding part of the bobbin 28, is wound on the winding part of the bobbin 28. Thereupon the thread is removed from storage through the thread eye 42. After a specific number of rotations, the bobbin spindles 44 are stopped and the wrap thread 4 is cut by means not shown. Thread eye 42 and thread brake 43 are transported into their position of rest and the end of the filling thread from the supply bobbin which extends out of the thread eye 42 is transported into the thread clamp 43 and clamped fast. The winder is thus again ready for operation.

Figure 7:
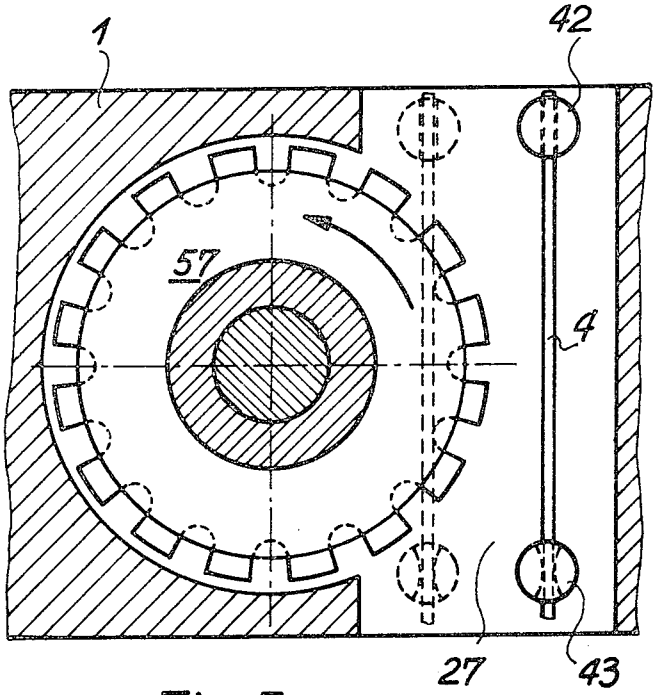
FIG. 7 shows a sectional view along the line VII—VII of FIG. 6.
Figure 6:
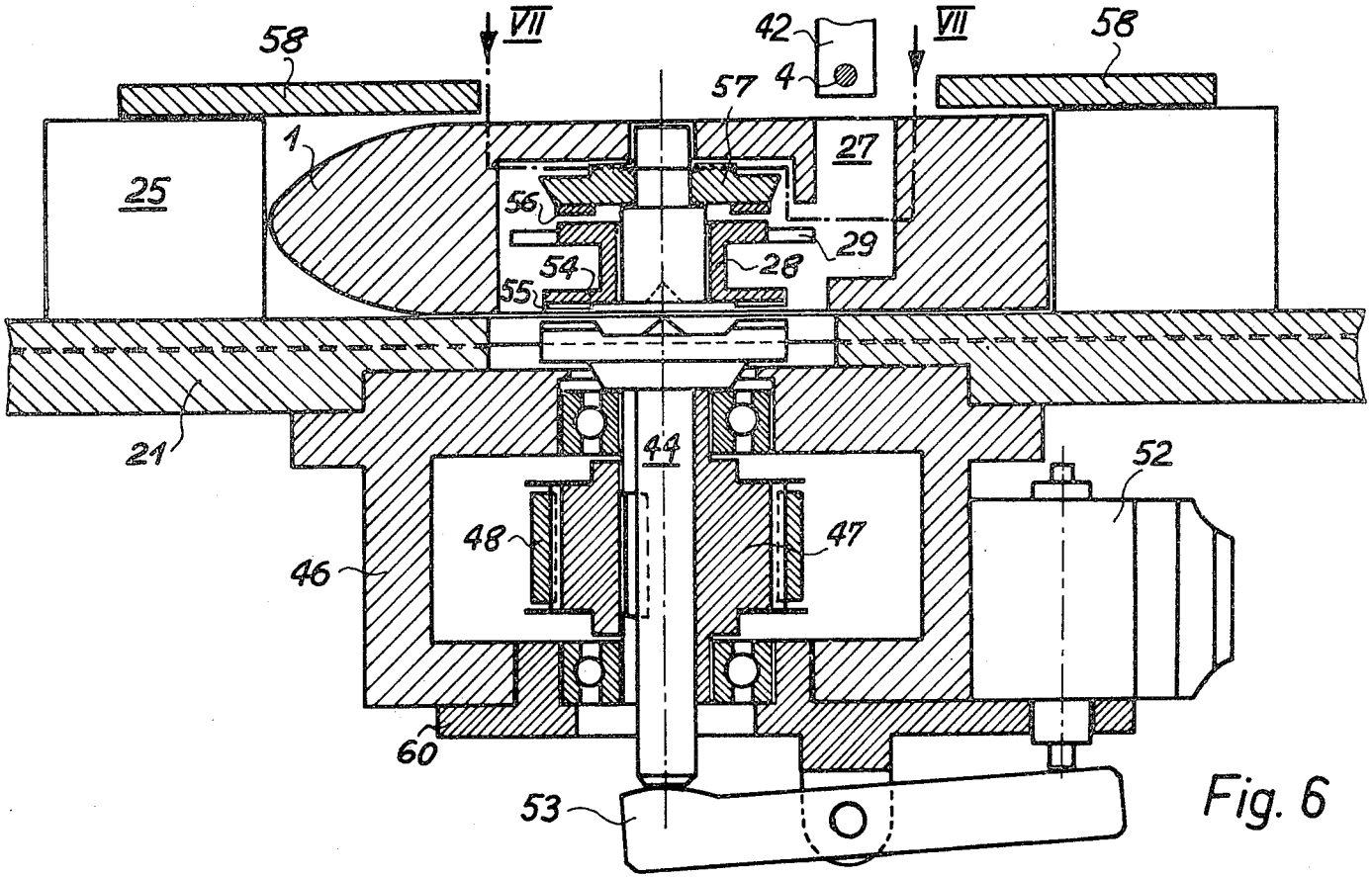
FIG. 6 shows a second embodiment of a winding station of the device in accordance with FIG. 1, seen in cross-section.
Figure 8:
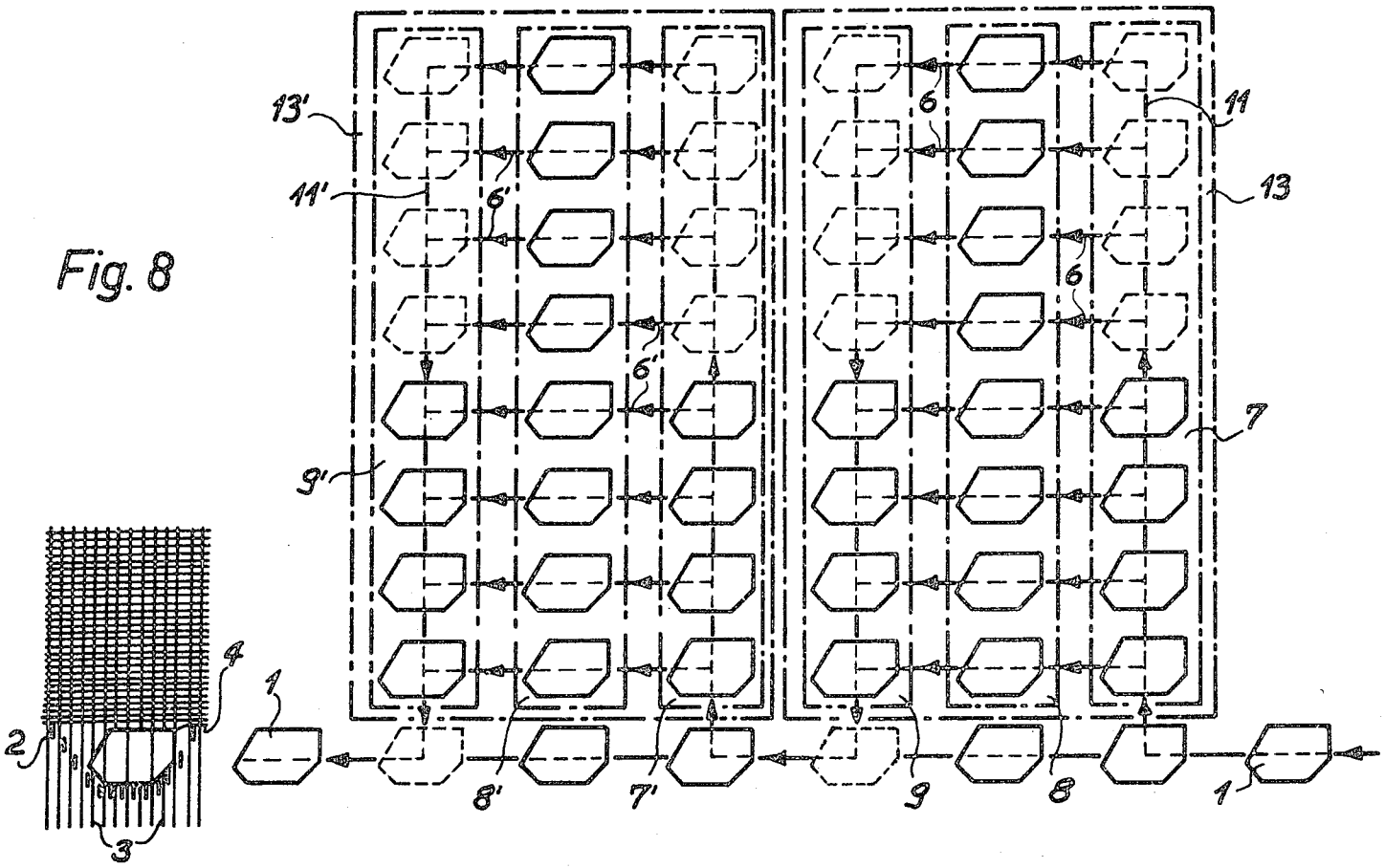
FIG. 8 shows a further development of the device shown in FIG. 1.

The winding device shown in FIGS. 6 and 7 differs from that shown in FIGS. 4 and 5 by the fact that the winding spindle 44 in addition takes over the function of the pusher 37 (FIG. 4). For this purpose the winding spindle 44 is supported for axial displacement and can be lifted by a coupling magnet 52 via a lever 53 and pressed against the bobbin 28. The bobbin 28 is provided on the outer surface of its lower flange 54 with a circular contact surface 55, possibly provided with drivers. The driving bobbin 30 (FIG. 4) is unnecessary and is replaced by a clamping plate 57 provided with a friction lining 56. The upper flange 29 of the bobbin 28, in analogy to the upper flange 31 of the driver bobbin 30 (FIG. 4), has the shape of a ratchet wheel. Since in this embodiment the shuttle 1 is pressed upward, covering means 58 are provided on the projections 25 of the conveyor belts 15 and prevent the shuttles 1 being pressed out of the spaces between the projections 25 of the conveyor belts 15.

In accordance with the further development of the arrangement shown in FIG. 1 which is shown in FIG. 1 can be arranged one behind the other in order to further reduce the speed upon the winding of the shuttles 1. No change is thereby made in the construction or operation of the devices 13, 13'. Since one shuttle 1 is fed on each occasion by the return transport device into the device 13 and the next following one is fed into the device 13', only the operating cycle of the continuously operating return transport device 12 need be twice as great as the operating cycle of the second transport device 11, 11' in the receiving station 7, 7' and the delivery station 9, 9' of the devices 13, 13'. Or stated generally: within devices $13_1$ to $13_n$ the operating cycle of the return transport device 12 must be n times as great as that of the second transport devices $11_1$ to $11_n$. The speed upon the filling of the shuttles 1 is reduced to 1/nth of the speed with only one device 13.

It will be appreciated that various changes and modifications may be made within the skill of the art without departing from the spirit and scope of the invention illustrated, described, and claimed herein.

What is claimed is:

1. Device for winding bobbins with filling threads which can be introduced together with a weaving shuttle into the shed of a loom, said device having a shuttle receiving station, a bobbin winding station for supplying weft thread to the shuttles, and a shuttle delivery station, said stations having several sections, with a first transport means for the stepwise transporting of the shuttles from one station into the following station and having separate rotating winders for withdrawing filling threads from a supply bobbin, the winders associated in fixed position individually with each section of the winding station, characterized by the fact that each station has the same number of sections and that a second transport means is provided for the stepwise filling of the receiving station with empty shuttles and the stepwise emptying of the delivery station of shuttles having bobbins wound with filling thread thereon, said second transport means within the receiving and delivery stations connecting the individual sections to each other and so cooperating with the first transport means that the number of transport steps of the second transport means corresponding to the number of sections in the individual stations takes place between every two transport steps of the first transport means.

2. The device according to claim 1 in which the direction of transport of the second transport means upon the filling of the shuttle receiving station is opposite the direction of transport upon the emptying of the shuttle delivery station.

3. The device according to claim 2 in which the first transport means and second transport means are each formed by endless first and second conveyor belts which are guided over rollers and developed in the manner of a toothed belt, a separate first conveyor belt common to all stations being provided for each section of the stations and a separate second conveyor belt common to all sections of receiving and delivery stations being provided for said stations, and in which the individual conveyor belts are adapted to be driven by a common step gearing, and all stations and sections are arranged in a common plane and the first conveyor belts which form the first transport means are oriented perpendicular to the second conveyor belts which form the second transport means.

4. The device according to claim 3 in which the first conveyor belts are provided on their outer side with first driving projections spaced apart in the longitudinal direction of the belt, the distance between every two adjacent first driving projections being greater than the length of a shuttle.

5. The device according to claim 4 in which the first conveyor belts are guided in the region between the rollers with their bottom side on a guide plate which is common to all sections and stations.

6. The device according to claim 5 in which the guide plate is provided in the region of each section of the winding station with an individual opening for the passage in each case of a winding mechanism to supply each shuttle with weft thread.

7. The device according to claim 3 in which the second conveyor belts are provided on their inner side with second driving projections spaced apart in the longitudinal direction of the belt, the distance between every two adjacent second driving projections being greater than the height of a shuttle.

8. The device according to claim 5 in which the second conveyor belts are so arranged that they surround the first conveyor belts from the outside.

9. The device according to claim 7 in which the second conveyor belts are so arranged that they surround the first conveyor belts from the outside.

10. The device according to claim 8 in which the height of the first and second driving projections is smaller than the thickness of the shuttle.

11. The device according to claim 8 in which the width of the second conveyor belts is less than the distance between two adjacent first drive projections of the first conveyor belts, and the second drive projections extend over the entire width of the second conveyor belts.

12. The device according to claim 11 in which the second conveyor belts are so arranged that the second drive projections in the condition of rest of the first conveyor belts extend in each case in a channel formed by the space between the first drive projections.

13. The device according to claim 8 in which the width of the first conveyor belts is smaller than the distance between two adjacent second drive projections of the second conveyor belts, and the first drive projections extend over about 30% to about 50% of the width of the first conveyor belts.

14. The device according to claim 13 in which the first conveyor belts are so arranged that the first drive projections in the condition of rest of the second conveyor belts extend in each case in the channel formed by the space between the second drive projections.

15. The device according to claim 1 in which an equal number of receiving stations, winding stations, and delivery stations each has the same number of sections, and the first and second transport means of the individual stations are so coupled with each other that from a number of shuttles fed to the device which corresponds to the number of receiving stations in each case the first is offered to the first receiving station and the last to the last receiving station.

16. The device according to claim 1 in which a continuously drivable return transport means is provided for the transport of the empty shuttles from the filling thread outlet side of the loom to the receiving station and for the transport of the filled shuttles from the delivery station to the filling-thread inlet side, and the drive of the return transport means is so coupled with that of the second tranport means that the receiving station is offered one shuttle between every two transport steps of the second transport means.

17. The device according to claim 15 in which a continuously drivable return transport means is provided for the transport of the empty shuttles from the filling thread outlet side to the receiving stations and for the transport of the filled shuttles from the delivery stations to the filling thread inlet side, and the drive of the return transport means is so coupled with the drives of the second transport means that a shuttle is offered to each receiving station between every two transport steps of its second transport means.

18. The device according to claim 1 in which a plurality of supply bobbins with different colored filling threads as well as a thread selecting device are associated with each section of the winding station.

19. The device according to claim 17 in which a plurality of supply bobbins with different colored filling threads and a thread selector mechanism are associated with each section of each winding station.

20. The device according to claim 1 in which the shed of the loom is an undulated shed.

* * * * *